United States Patent [19]

Funk

[11] Patent Number: 4,819,900

[45] Date of Patent: Apr. 11, 1989

[54] ADJUSTABLE, HEAVY DUTY GARAGE SHELF ASSEMBLY

[76] Inventor: George W. Funk, 22512 Neptune Ave., Carson, Calif. 90745

[21] Appl. No.: 241,490

[22] Filed: Sep. 8, 1988

[51] Int. Cl.[4] ..... E04G 5/06

[52] U.S. Cl. ..... 248/244; 108/108

[58] Field of Search ..... 248/125, 413, 218.4, 248/219.1, 235, 243, 244, 245, 247, 295.1, 296, 161; 182/146; 108/107, 108, 151, 152

[56] References Cited

U.S. PATENT DOCUMENTS

| | | | |
|---|---|---|---|
| 295,579 | 3/1884 | O'Brien | 248/244 |
| 446,472 | 2/1891 | Roberts | 248/245 |
| 450,289 | 4/1891 | Gottfried | 248/245 |
| 912,936 | 2/1909 | Cowdrey | 108/152 |
| 1,189,988 | 7/1916 | Moody | 248/247 |
| 2,833,503 | 5/1958 | Harshbarger | 248/235 |
| 3,184,068 | 5/1965 | Wende | 108/107 |
| 3,510,097 | 5/1970 | McCaleb | 248/243 |
| 3,701,325 | 10/1972 | Fenwick | 108/152 |
| 3,776,498 | 12/1973 | Peters | 248/219.1 |
| 3,794,282 | 2/1974 | Shell | 248/244 |
| 4,537,379 | 8/1985 | Rhoades | 248/244 |

FOREIGN PATENT DOCUMENTS

| | | | |
|---|---|---|---|
| 867349 | 2/1953 | Fed. Rep. of Germany | 108/108 |
| 3243215 | 3/1984 | Fed. Rep. of Germany | 248/125 |
| 6413491 | 5/1965 | Netherlands | 248/243 |
| 625693 | 10/1981 | Switzerland | 248/296 |
| 812926 | 5/1959 | United Kingdom | 248/243 |

*Primary Examiner*—Ramon O. Ramirez
*Assistant Examiner*—Robert A. Olson
*Attorney, Agent, or Firm*—Monty Koslover Assoc.

[57] ABSTRACT

A heavy duty garage shelf assembly having shelf brackets that may be easily moved up or down and adjusted in place. The assembly is comprised of two steel vertical support tubes that are each bolted to a wall by a clamp at the top and a shoe-clamp at the bottom; and a number of shelf brackets. The shelf-brackets are made of steel tubing welded to form a cantilevered right triangle, with the base of the triangle being a tube that fits over the vertical support tubes and can slide up and down. The shelves are 0.75 in. thick in 1 in. thick wood plywood and are bolted to the shelf brackets. The garage shelf assembly, when using 1½ inch diameter vertical support tubes, is capable of supporting up to 200 pounds total load on its shelves. For heavier loads, larger diameter vertical support tubes of 1.75 inch or 2 inches diameter should be used. The shelves can be extended in length by the addition of a vertical support tube and shelf brackets a distance apart at either end of the assembly.

3 Claims, 2 Drawing Sheets

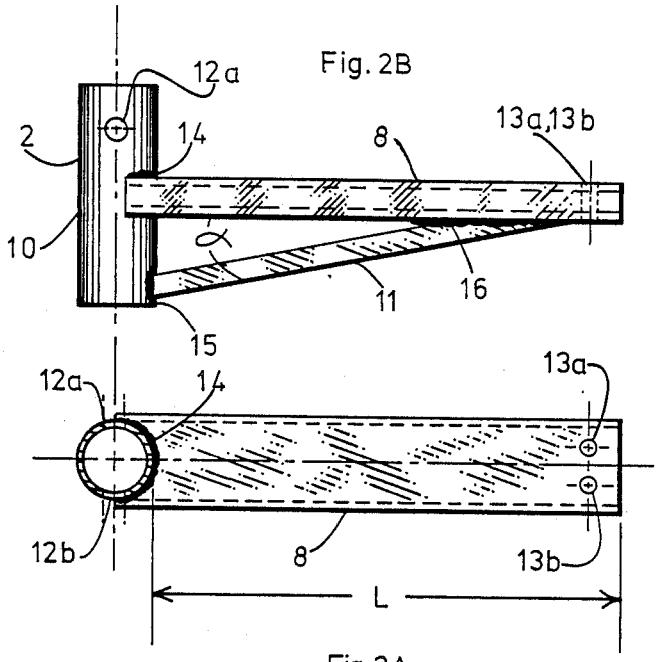
Fig, 2A
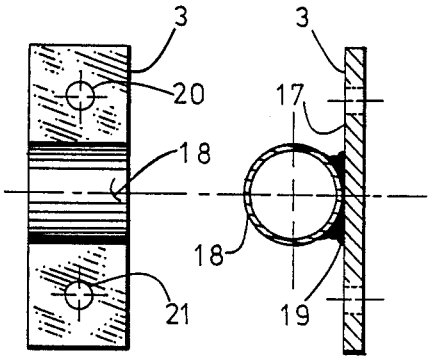
Fig.3A
Fig.3b
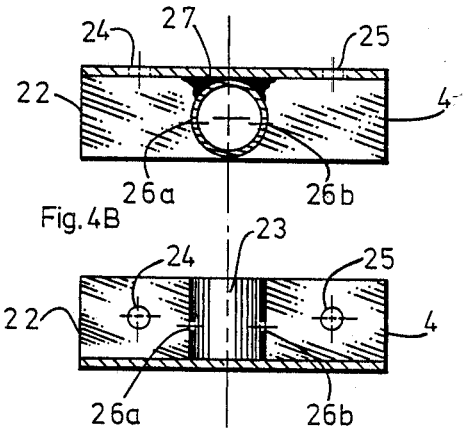
Fig.4B
Fig. 4A
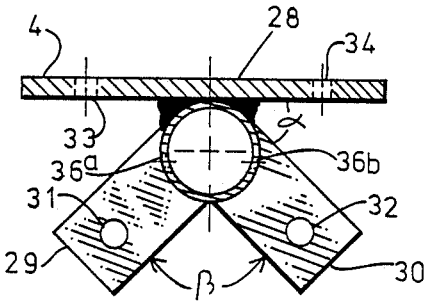
Fig.5B
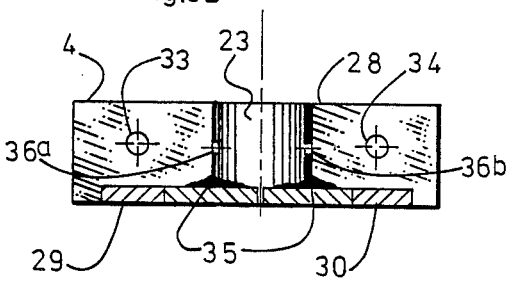
Fig 5A

ADJUSTABLE, HEAVY DUTY GARAGE SHELF ASSEMBLY

BACKGROUND OF THE INVENTION

1. Field of the Invention

This invention relates to an improved shelf assembly for use in home and professional garages for the purpose of storing heavy components.

2. Description of the Prior Art

Many shelf assemblies exist and have been available for some time. These shelf assemblies may be free-standing, or may be supported tied to a wall. An example of the latter is described in U.S. Pat. No. 3,701,325 by Jay G. Fenwick. In this patent, slotted vertical supports are fastened to a back wall. Shelf brackets having hooks, are fitted into slots in the vertical supports and a metal shelf made of welded rods is fitted on top of the shelf brackets. The whole forms a lightweight adjustable shelf assembly. The assembly will support light weight objects, but does not appear suitable for heavy, bulky objects such as automotive equipment. Free-standing metal shelving assemblies for use in garages and other places, are typically constructed of vertical, angled supports, two on each end, and metal shelfs that are bolted between each set of angled supports. One or more cross-braces may be bolted diagonally across the back of the assembly for rigidity. Such a design is familiar and generally available in hardware stores. The shelving on these assemblies are not however, generally adjustable, since the shelves form part of the construction holding the assembly rigid. Free-standing shelf assemblies also take up more floor space than do wall-mounted assemblies, and in a home garage, such additional floor space may not be available. Thus, there exists a need for an adjustable shelf assembly that is supported tied to a wall, and capable of supporting heavy, automotive type equipment and objects for use in a home garage or professional garage.

SUMMARY OF THE INVENTION

The invention comprises two steel support tubes per assembly, each steel support tube being clamped and bolted to the wall at the top, and resting in a shoe at its bottom end, the shoe being bolted to the wall or floor; an adjustable bracket assembly that is capable of being moved up or down each support tube as desired and bolted in place, and a wood or metal shelf that is bolted to each bracket assembly. Depending on the height of the support tubes, there may be one or more sets of bracket assemblies or shelves in a given shelf assembly. Support tubes and bracket assemblies may be added to either end and the shelves fastened to the brackets so as to make continuous shelving. The materials used throughout are massive and capable of heavy duty in holding heavy, automotive type equipments.

Accordingly, it is a principal object of this invention to provide an adjustable shelf assembly that is supported tied to a wall, and capable of supporting heavy automotive type equipment.

Another object is to provide an assembly having shelves that are easily adjustable in height at any time after full assembly and installation.

It is another object to provide an adjustable shelf assembly that is simple to erect as well as being strong. Further objects and advantages of the invention will become apparent from the following specification, drawings and appended claims.

BRIEF DESCRIPTION OF THE DRAWINGS

In the drawings:

FIGS. 2A and 2B are respectively a plan view and side elevational view of a shelf bracket assembly;

FIGS. 3A and 3B are respectively a plan view and side elevation view of a tube-clamp assembly;

FIGS. 4A and 4B are respectively a front elevational view and a plan view of a first preferred shoe-clamp assembly; and FIG. 5A and 5B are respectively a front elevational view and a plan view of a second preferred shoe clamp assembly.

DESCRIPTION OF THE PREFERRED EMBODIMENTS

Figure 1:
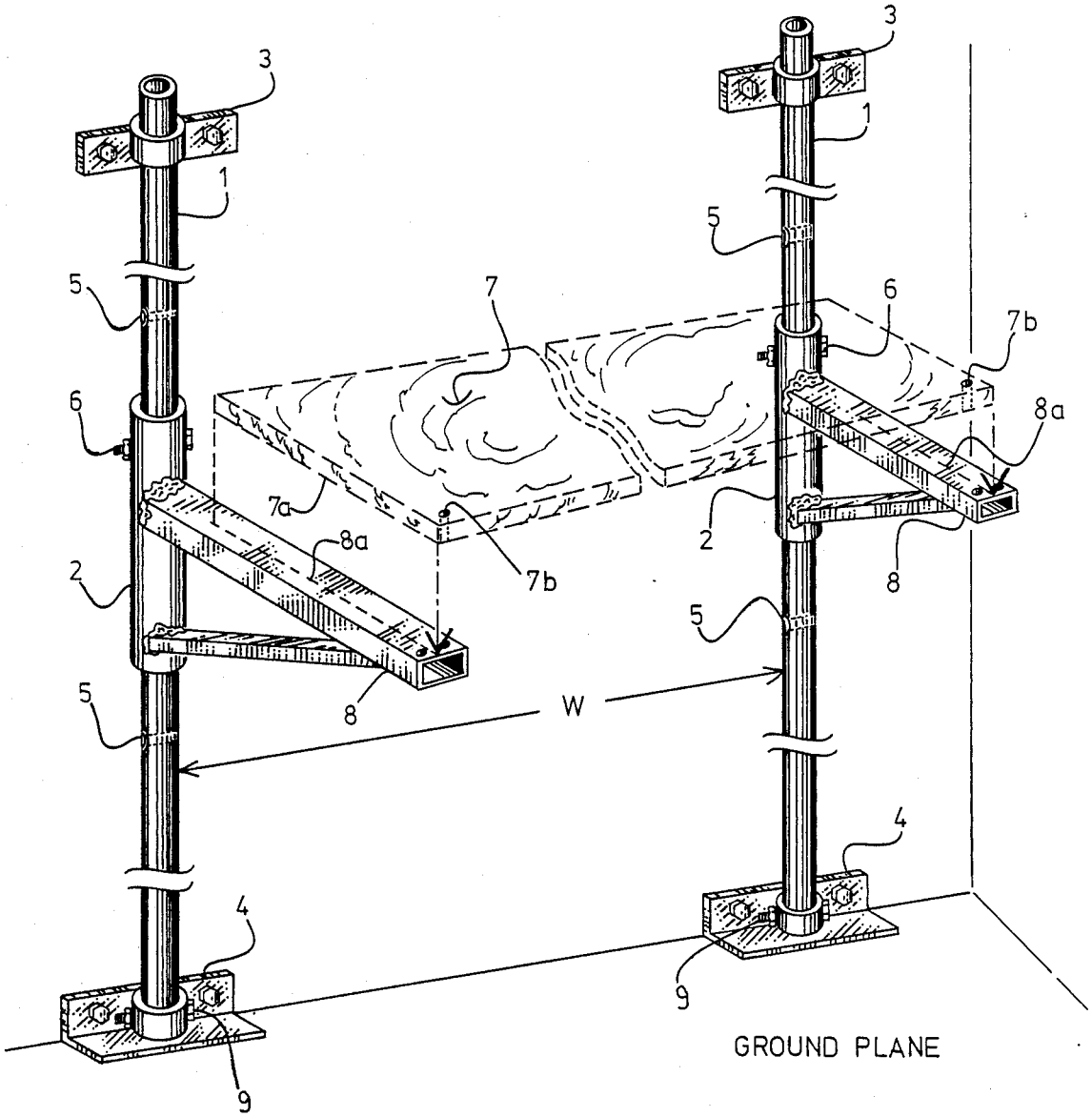
FIG. 1 is a partially exploded perspective view of the garage shelf assembly in accordance with the invention, showing the vertical tube supports bolted to a wall and standing on a floor, and a wood or metal shelf for bolting to the shelf bracket assemblies.

Referring to the drawings, there is shown in FIG. 1 a partially exploded perspective view of an adjustable, heavy duty garage shelf assembly comprising vertical tube supports 1, shelf bracket assemblies, 2, tube-clamp assemblies 3, shoe-clamp assemblies 4 and a shelf 7, in accordance with the present invention.

Only one section or assembly comprising two vertical tube supports is illustrated, and only one set of shelf bracket assemblies 2 and shelf 7 are illustrated for clarity. However, a multiple number of shelf bracket assemblies and shelves can be employed, depending on the height of the tube supports 1 and the desired number of shelves. For an 8½ foot high tube support 1, typically three or four sets of bracket assemblies 2 may be used and vertically spaced 1½ to 2 feet apart. The shelf bracket assemblies 2 are fastened by a bolt and a nut 6 through any one of a multiplicity of holes 5 in the vertical tube support 1. Additional vertical tube supports and shelf bracket assemblies may be added at a distance W of 36 inches or less at either end to extend the sections of the garage shelf assembly.

For installing the assembly, the following sequence is recommended: First, the shoe-clamp assemblies 4 are located on the floor and bolted to the wall. Second, one or more shelf bracket assemblies 2 are slid on to the vertial tube support 1 and a tube-clamp assembly 3 is added to the top. Third, the bottom of the tube support 1 is then inserted in the tube receptacle portion of the shoe-clamp assembly 4 and pinned in place by a bolt or pin 9. Fourth, the tube-clamp assembly 3 is located at the top of the tube support 1 and bolted to the wall. The shelf bracket assemblies 2 may then be moved up or down the tube support and bolted in place. Finally, the shelf 7 is placed on the shelf bracket assembly 2 so that its edges **7*a* are approximately on the center line 8*a* top surface of main bracket 8, and is bolted through holes 7*b* to the shelf bracket assembly 2**.

The dimensions of the vertical tube support 1 are a variable depending on the shelf assembly load rating. For a total load rating of 100 pounds per support, the tube outside diameter would be 1.5 inches with a wall thickness of at least 0.100 inches seamless mild steel, and a tube height or length of no more than 9 feet. Higher total load ratings would require support tube diameters of 1.75 inches or 2.0 inches. The dimensions of the clamps and shelf bracket assemblies are similarly affected by the selected diameter of the vertical tube support 1, in order to fit over it. The extended length L of the shelf bracket assembly may vary from approximately 14 inches to 16 inches maximum to accomodate the high shear and bending stresses that may be imposed on its cantilevered construction by heavy loads.

All assembly materials except for the shelf 7 are preferably made of mild steel. The shelf 7 is typically 0.75 inch thick or 1 inch thick plywood. The distance between supports W should be no more than 36 inches in order to avoid undue flexure of the shelf 7. Each shelf 7 has two holes **7*b* bores axially in it near its end for bolts fastening it to the shelf bracket assembly 2. For particularly heavy loads, an angle bar (not illustrated) should be added at the front edge of the shelf 7 and bolted with the shelf to the shelf bracket assembly 2**.

Referring now to FIGS. 2A, 2B, 3A, 3B, 4A and 4B there are shown details of the shelf bracket assembly 2, the tube-clamp assembly 3 and shoe-clamp assembly 4 according to the present invention. In addition, FIGS. 5A and 5B illustrate details of an alternate preferred design of the shoe-clamp assembly 4.

Referring particularly to FIGS. 2A and 2B, the shelf bracket assembly 2 which is illustrated comprises tube-slider 10, a main bracket 8 and support bar 11, welded together in a configuration forming a triangular cantilevered support. The angle $\alpha$ between the support bar 11 and the bottom surface of main bracket 8 is approximately 15 degrees, and the assembly components are welded at three places 14, 15 and 16 for rigidity. First holes **12*a* and 12*b* are bored through tube slider 10 transverse to its longitudinal axis, to accomodate the bracket fastening bolt 6. Second and third holes 13*a* and 13*b* are located near the end of main bracket 8 and bored through the main bracket 8 across its rectangular section, to accomodate the bolts which fasten the shelf 7 to the main bracket 8. As illustrated, the main bracket is of rectangular tubing, having a cross-sectional dimension of 2 inches by 1 inch and 0.100 inch wall thickness. The length L may be from 14 to 16 inches. Support bar 11 is a rectangular tube, 0.5 inch by 0.5 inch in cross-section. The diameter of the tube-slider 10 is selected to match the outside diameter of the vertical tube support 1, so that it can slide over the tube support 1** with sufficient clearance.

FIGS. 3A and 3B illustrate the tube-clamp assembly 3 in plan and side elevation views. The assembly comprises a plate 17 and a segment of tubing 18 that is welded 19 transverse to the plate 17. A first and second hole 20 and 21 are drilled in the plate 17 to accomodate wall-fastening bolts. The plate 17 is 0.125 inches thick. This plate thickness raises the vertical tube support 1 off the wall by the given amount when the tube clamp assembly is placed over it, allowing clearance for the shelf bracket assembly 2 to slide in adjustment. The diameter of the tubing 18 is selected to match the outside diameter of the vertical tube support 1, so that the tube-clamp can fit over the tube support 1, holding it in place.

FIGS. 4A and 4B illustrate the shoe-clamp assembly 4 in plan and front-elevational views. This assembly comprises an angle piece 22 and a second segment of tubing 23. This second segment of tubing 23 is identical in size to the first segment of tubing 18 that is used in tube-clamp assembly 3. This is because tubing 23 fits over the bottom of vertical tube support 1, while tubing 18 fits over the top. Tubing 23 is welded parallel to angle piece 22 in the approximate center of angle piece 22 and perpendicular to its long axis. First and second holes 24 and 25 are drilled in the angle piece 22 and located to accomodate wall-fastening bolts. A third and fourth hole **26*a* and 26*b* are drilled axially through second segment of tubing 23 to accomodate pin or bolt a that is used to fasten the vertical tube support in place, preventing rotation. The angle piece 22 is made of 0.125 inch thick steel angle, and should have a length that is at least three times the diameter of tubing 23** for the best stability and support.

Referring now to FIGS. 5A and 5B, there is shown a front elevational view and a plan view of a second preferred shoe-clamp assembly 4. This alternate shoe-clamp assembly gives a wider floor support than the previously described shoe-clamp assembly. The assembly illustrated in FIGS. 5A and 5B is recommended for the heavier loaded garage shelf assemblies. As illustrated, the second preferred shoe-clamp assemlby 4 comprises a wall plate 28, two floor plates 29 and 30 and second segment of tubing 23. The two floor plates 29 and 30, are welded 35 to the bottom of tubing 23 and arranged in an angle $\beta$ 90 degrees apart. This forms a foot subassembly much in appearance like a crow's foot. The welded three-piece subassembly is then welded to the wall plate 28 so that the edges of the floor plates 29 and 30 make an angle $\alpha$ of 45 degrees with the surface of wall plate 28. First and second holes 33 and 34 are drilled in the wall plate 28 and located to accomodate wall-fastening bolts. Third and fourth holes 31 and 32 are drilled in floor plates 29 and 30 to accomodate floor fastening bolts. The wall plate 28 is made of 0.125 inch thick steel plate as are floor plates 29 and 30.

Having described the invention, what is claimed is:

1. A garage shelf assembly having adjustable shelves and constructed to support heavy loads while fastened to a garage wall, the assembly comprising:

(a) two vertical tube supports that may be fastened to a wall;

(b) a multiplicity of shelf bracket assemblies that, when secured to said vertical tube supports, provide a surface for supporting and fastening shelves thereto;

(c) two tube-clamp assemblies, one per vertical tube support, adapted and designed to fasten said vertical tube support to a wall near the top of the tube-support leaving clearance between the wall and said vertical tube support to allow movement up or down of said shelf bracket assemblies;

(d) two shoe-clamp assemblies, one per vertical tube-support, adapted and designed to fasten said vertical tube support to a wall at the floor and to provide floor support; and (e) a multiplicity of shelves;

said vertical tube supports being made of mild steel seamless tubing with a wall thickness of a least 0.100 inches, an outside diameter of 1.5 inches and a maximum length of 9 feet, said supports being capable of supporting 100 pounds weight per support; said vertical tube supports having a multiplicity of holes bored axially through each support at intervals to receive bolts that fasten said shelf-bracket assemblies thereto; said vertical tube supports having an outside diameter of 1.75 inches or 2.0 inches for load rating of more than 100 pounds per support;

said shelf bracket assemblies being made of mild steel and comprising: a tube slider, a main bracket and a support bar; said slider, bracket and support bar being welded together in three places forming a triangular cantilevered support; said tube slider being made of seamless steel tubing, with a wall thickness of a least 0.100 inches and an outside diameter which is selected to match the outside diameter of said vertical tube support, so that it can slide over said tube support; said tube slider having a first hole bored axially through it to accomodate a bracket fastening bolt; said main bracket being made of rectangular tubing 2 inches by 1 inch in cross-sectional dimension, having a wall thickness of 0.100 inch and a length of from 12 to 16 inches; said main bracket having second and third holes located near one end and bored axially through it perpendicular to the bracket wider surfaces; said main bracket being welded at the distal end perpendicularly to the axis of said tube slider; said support bar being made of square cross-section tubing approximately 0.50 inch by 0.50 inch, said support bar being welded at one end to the under surface of said main bracket near to its free end, and welded at its distal end to said tube slider so that said support bar, said main bracket and said tube slider form a right triangle with the enclosed angle between said support bar and main bracket being approximately 15 degrees; said shelf bracket assembly being rigid and constructed to support loads in excess of 100 pounds; said shelf bracket assembly being able to move up or down said vertical tube support to desired locations and fixed in place;

said tube-clamp assemblies being made of mild steel and comprising a plate and a first segment of tubing; said plate having a first and second hole bored axially in it to accomodate wall fastening bolts; said first segment of tubing being made of seamless steel tubing with a wall thickness of a least 0.100 inches and an out-side diameter which is selected to match the outside diameter of said vertical tube suport, so that said tube-clamp assembly can fit over said tube support; said first segment of tubing being sized to fit the width of said plate and welded at the center of said plate with its axis at 90 degrees to the length of said plate; said plate having a thickness of 0.125 inch, and this plate thickness being selected to provide clearance between the wall and said vertical tube support to allow movement up or down for adjusting said shelf bracket assemblies;

said shoe-clamp assemblies being made of mild steel and comprising an an angle-piece and a second segment of tubing; said second segment of tubing being identical in size to said first segment of tubing that is used in said tube-clamp assembly; said angle piece being made of 0.125 inch thick steel angle and having a length of at least three times the diameter of said second segment of tubing; said angle piece having first and second holes bores in it and located to accomodate wall fastening bolts; said second segment of tubing having holes bored axially through it to accomodate a bolt or pin that is used to fasten said vertical tube support in place, preventing rotation; said second segment of tubing being located and welded at the center of said angle piece, so that one end of said tubing rests on and is enclosed by, a horizontal surface of said angle piece, the distal end of said second segment of tubing being open to receive and accomodate the lower end of said vertical tube support;

said shelves being typically 0.75 inch thick or 1 inch thick plywood, from 12 inches to 16 inches wide and a maximum of 36 inches long; said shelves having two holes bored in each shelf near its distal ends to accomodate bolts fastening it to said shelf bracket assembly.

2. A garage shelf assembly according to claim 1 wherein:

said shoe-clamp assembly is alternatively designed for heavy loads and is configured for wide floor support, said horizontal surface of said angle piece of said shoe-clamp assembly including two floor plates disposed at an angle 90 degrees apart, forming a foot subassembly shaped like a crow's foot; said floor plates each having a hole bored axially in it to accomodate floor fastening bolts.

3. A garage shelf assembly according to claim 1 including at least one additional vertical tube support and shelf bracket assembly, said additional vertical tube support located at a distance of up to 36 inches from the first vertical tube supports, thereby extending the sections and shelves of said garage shelf assembly.

* * * * *